United States Patent [19]

Schrieber

[11] 4,289,612

[45] Sep. 15, 1981

[54] PHOSPHATE ORE TRIPLE FLOAT

[75] Inventor: Glenn H. Schrieber, Aurora, N.C.

[73] Assignee: Texasgulf Inc., Stamford, Conn.

[21] Appl. No.: 158,380

[22] Filed: Jun. 11, 1980

[51] Int. Cl.[3] ..... B03D 1/02

[52] U.S. Cl. ..... 209/166; 209/12

[58] Field of Search ..... 209/166, 167, 12

[56] References Cited

U.S. PATENT DOCUMENTS

| | | | |
|---|---|---|---|
| 2,614,692 | 10/1952 | Lawver | 209/166 |
| 2,676,705 | 4/1954 | Duke | 209/166 |
| 2,706,558 | 4/1955 | Houston | 209/166 |
| 2,750,036 | 6/1956 | Hunter | 209/166 |
| 2,914,173 | 11/1959 | LeBaron | 209/166 |
| 3,013,664 | 12/1961 | Hollingsworth | 209/166 |
| 3,419,140 | 12/1968 | Jepsen | 209/12 |
| 4,189,103 | 12/1980 | Lawver | 209/12 |
| 4,220,523 | 9/1980 | Raulerson | 209/17 |

*Primary Examiner*—Robert Halper

*Attorney, Agent, or Firm*—Denis A. Polyn

[57] ABSTRACT

A process for the improved beneficiation of phosphate ore in which the double float cationic (i.e., amine) floatation step is performed in two stages instead of the standard single stage, and which permits recovery of approximately two-thirds of the phosphate values that were previously lost in the amine tailings of the standard single stage process.

5 Claims, 1 Drawing Figure

PHOSPHATE ORE TRIPLE FLOAT
FLOW SHEET
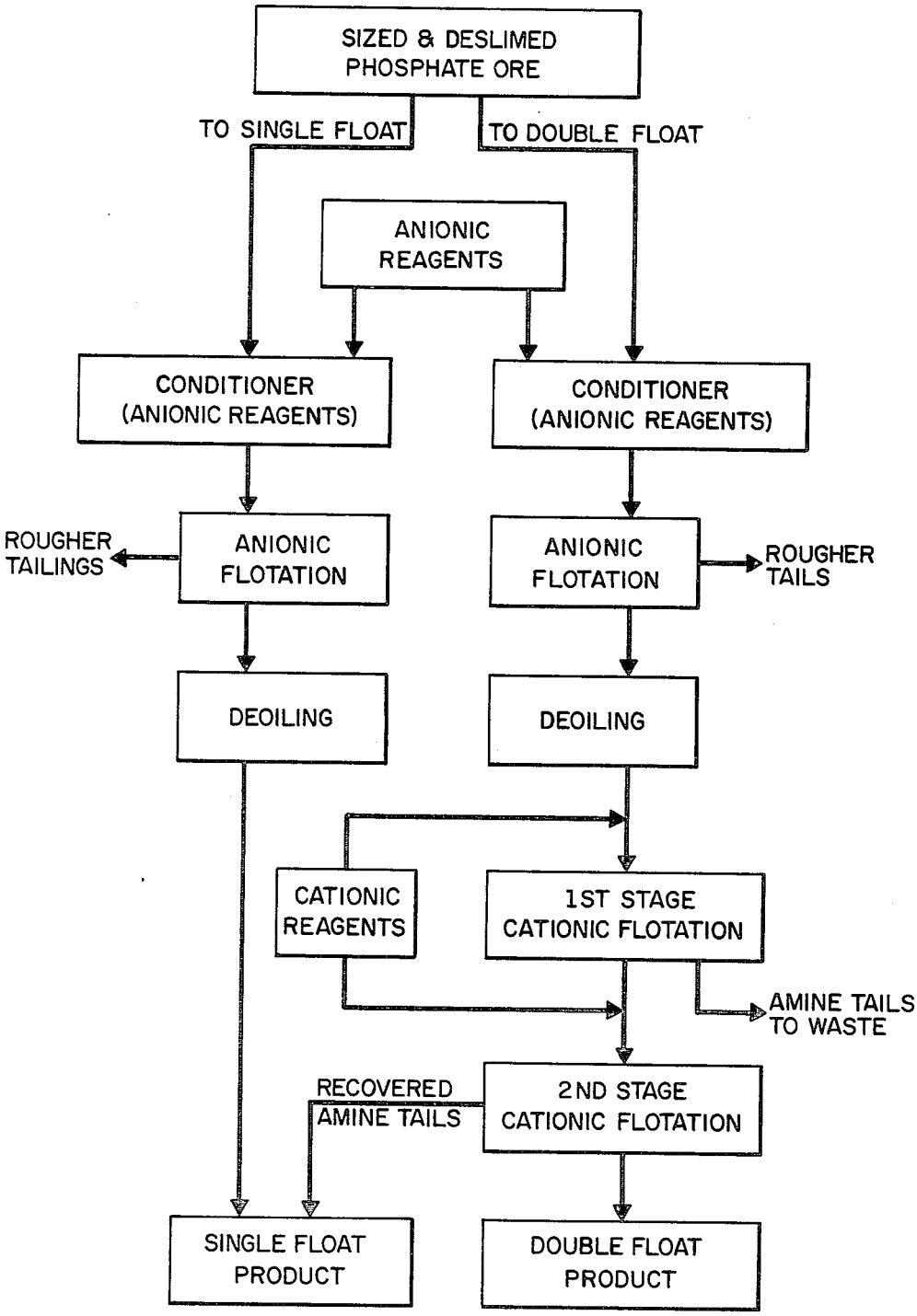

PHOSPHATE ORE TRIPLE FLOAT

BACKGROUND OF THE INVENTION

1. Field of the Invention

This invention relates to a process for beneficiating phosphate ore, and, more particularly, to a process by which phosphate ore can be beneficiated with improved recovery in the cationic floatation step.

2. Description of the Prior Art

A standard method for the beneficiation of phosphate ore is called "double float". The phosphate ore is first floated with any of one or more of several well-known anionic reagents (i.e., fatty acids), which leaves the rougher tailings low in phosphate values. This "single float" product still contains some silica, which is then scrubbed with sulfuric acid to remove the reagents and then subjected to floatation using any of one or more of several well-known cationic reagents (i.e., amines). The majority of the remaining silica is floated away, leaving a "double float" product high in phosphate values and very low in silica. The tailings (i.e., silica component) from the amine floatation still contain more phosphate values than is desireable to discard as waste, but the values are not great enough to be utilized as a product.

I have now discovered that it is possible to recover approximately two-thirds of the phosphate values that were previously lost in the amine tailings.

These lost phosphate values are recovered by modifying the standard "double float" process to a "triple float" process by removing the tailings in the amine float in two stages instead of one, and, surprisingly, this is accomplished with approximately the same volume of amine reagent currently utilized in the "double float" process.

SUMMARY OF THE INVENTION

An improved process for the beneficiation of phosphate ore wherein the ore is floated with anionic reagent to produce a single float product, the single float product is treated with acid to remove anionic reagent, and the acid treated single float product is floated with cationic reagent to produce a double float product, wherein the improvement comprises:

(a) performing said cationic floatation in first and second stages;

(b) adding cationic floatation reagent in starvation amounts in said first stage with a low floatation retention time to produce a float containing most of the silica from the ore which is discarded; and, (c) adding additional cationic floatation reagent to the phosphate ore remaining from said first stage to said second stage with a sufficient floatation retention time to produce a float containing most of the phosphate from the amine tailings which is recovered.

A preferred embodiment of the instant invention comprises utilizing a cationic floatation reagent selected from the group comprising Natrochem Inc. JJ-95, Westvaco Inc. Custamine 705 and AZ Products Inc. A-33A.

A second preferred embodiment of the instant invention comprises utilizing a first stage low floatation retention time of about one-third the normal time for cationic floatation.

A third preferred embodiment of the instant invention is mixing the cationic floatation tailings from the second stage with an entirely separate single float product.

A fourth preferred embodiment of the instant invention is utilizing the cationic floatation product from the second stage as a traditional double float product.

A fifth preferred embodiment of the instant invention is utilizing approximately the same amount of cationic floatation reagent in the first and second stages as used in a traditional double float process.

BRIEF DESCRIPTION OF THE DRAWING

The FIG. is a schematic diagram illustrating a flowsheet useful in carrying out the invention.

DESCRIPTION OF THE PREFERRED EMBODIMENT

In order to achieve the maximum benefit from this "triple float" process, it may be desireable for a phosphate ore manufacturer to have a use for a secondary, or lower grade, product as well as the traditional "double float" product. The lower grade product may consist of phosphate ore that has been processed with only an anionic floatation step, traditionally referred to as a "single float" product, which is then mixed with the instant second stage floatation tailings.

Reference is now made to the FIG., in which a simplified schematic representation of a flowsheet for beneficiating phosphate ore by a "triple float" process is shown. In the description which follows, as in the FIG., supporting structure which would be conventionally supplied has been omitted in the interest of simplicity of presentation. It will therefore be understood that sized and de-slimed phosphate ore can be beneficiated by a single float process or by a double float process. In both the single and double float processes the same anionic (i.e., fatty acid) reagents are utilized. Typical anionic reagents are Union Camp CTF, Westvaco Inc. Liqro T and Arizona Chemicals Co. FA 140. The phosphate values are floated with the anionic reagent, leaving the rougher tailings low in phosphate. In both the single and double float processes the phosphate rich component is then scrubbed with an acid, preferably sulfuric acid, to remove (i.e., de-oil) the anionic reagents. After deoiling, the single float product can be utilized, if desired, without further processing. To produce a double float product, a further cationic floatation step is required.

As indicated on the FIG., I have discovered that it is possible to recover approximately two-thirds (66%) of the phosphate values lost by the traditional double float method by performing the cationic floatation step in two, instead of one, stages. The same cationic (i.e., amine) reagents used for the double float are also used in the instantly claimed triple float process. Typical cationic reagents are Natrochem Inc. JJ-95, Westvaco Inc. Custamine 705 and AZ Products Inc. A-33A. It should be noted that approximately the same plume of cationic reagent is used in both the double float and triple float process.

The amine flotation reagents are compositions containing a cationic nitrogen group and a hydrophobic chain. Therefore, stearyl amine and tallow amine are suitable for this purpose. To achieve good water dispersability, acetates of these amines are advantageously used. However, these long chain fatty amines and their acetate salts are not too selective in floating sand; some phosphate ore particles are also lost in the process. In order to reduce this phosphate loss, a composition prepared from the condensation of polyalkylene polyamine and a fatty acid is advantageously used. Thus, diethylene triamine is reacted with tall oil fatty acid to produce a reagent containing one cationic nitrogen group and two fatty amide groups. Better water dispersability is achieved by using the acetate salt of the diethylene triamine fatty acid reaction product. A much preferred product for flotation is a mixture of the tallow amine acetate and polyalkylene polyamine fatty acid acetate. Examples of the fatty acid are myristic, oleic, stearic, palmitic, isostearic, soybean, tallow, lard, tall oil, caster and the like. Examples of polyalkylene polyamines are diethylene, triamine, triethylene, tetramine, 3-3 iminobispropylamine, and the like.

The triple float process requires that the cationic floatation be performed in two stages. In the first stage, cationic reagent is added in starvation amounts and the floatation retention time is low (i.e., about one-third the time required for traditional cationic floation). The combination of starvation amounts of cationic reagent and low floatation retention time results in amine tailings (i.e., the floated ore) that contains most of the silica from the feed but very little phosphate. The amine tailings from the first stage are discarded. The product from this first stage treatment is not the final grade product. The product from the first stage is then subjected to the second stage of floatation with additional cationic reagent. This second stage requires that additional cationic floatation reagent be added to the phosphate ore remaining from said first stage with enough floatation retention time to produce a float material (i.e., recovered amine tails) containing most of the phosphate values from the amine tailings. The product from the second stage can be utilized as a traditional double float product.

The following table is included to illustrate the expected increased amount of recovered phosphate values, utilizing a hypothetical one hundred thousand tons of phosphate ore that has first been sized and de-slimed before being subjected to the triple float two stage cationic reagent floatation process.

THEORETICAL MATERIAL BALANCE

| | Tons | % P205 | Tons P205 |
|---|---|---|---|
| 14 × 200 Mesh Ore | 100,000 | 16.93 | 16,931.7 |
| Float Feed, Single Float | 73,696 | 16.94 | 12,484.9 |
| Float Feed, Triple Float | 26,304 | 16.91 | 4,446.9 |
| Fatty Acid Tails, Single Float | 31,672 | 2.29 | 926.7 |
| Fatty Acid Tails, Triple Float | 11,052 | 2.66 | 293.8 |
| Fatty Acid Conc., Single Float | 42,024 | 27.50 | 11,558.1 |
| Fatty Acid Conc., Triple Float | 15,253 | 27.23 | 4,153.0 |
| Amine Tails, Triple Float Total | 2,465 | 11.20 | 276.1 |
| Amine Tails To Single Float | 956 | 19.46 | 186.1 |
| Amine Tails to Waste | 1,508 | 5.97 | 90.0 |
| Amine Concentrate | 12,788 | 30.32 | 3,877.0 |
| Single Float Tons To Pile | 42,980 | 27.32 | 11,744.2 |
| Triple Float Tons To Pile | 12,788 | 30.32 | 3,877.0 |

The following example is presented to further describe and illustrate the process of this invention.

EXAMPLE

A sample of North Carolina phosphate ore is floated with an anionic reagent to produce a single float product, the single float product is treated with acid to remove anionic reagent, and the acid treated single float product is then floated with cationic reagent in first and second stages to produce a triple float product. The cationic flotation reagent, which is a mixture of Natrochem Inc. JJ-95, Westvaco Inc. Custamine 705, AZ Products Inc. A-33A and No. 2 fuel oil, is added in starvation amounts in the first stage with a low flotation retention time to produce a float containing most of the silica from the ore which is discarded. Additional cationic flotation reagent is added to the phosphate ore remaining from the first stage to the second stage with a sufficient flotation retention time to produce a float containing most of the phosphate from the amine tailings which is recovered. A representative amount of cationic reagent added is as follows:

| | Amine | No. 2 Fuel Oil |
|---|---|---|
| First Stage | 0.83 | 0.54 (estimate) |
| Second Stage | 0.69 | 0.54 (estimate) |
| Total | 1.52 | 1.08 (actual) |

The numbers shown above are pounds of reagent per ton of final high grade product. The amine is added as a ten percent (10%) solution in water, and the pounds per ton refer to pure amine and not amine solution. The No. 2 Fuel Oil is not diluted.

I claim:

1. An improved process for the beneficiation of phosphate ore wherein the ore is floated with anionic reagent to produce a single float product, the single float product is treated with acid to remove anionic reagent, and the acid treated single float product is subjected to cationic floatation with cationic reagent to produce a double float product, wherein the improvement comprises:

(a) performing said cationic floatation in first and second stages;

(b) adding cationic floatation reagent in starvation amounts in said first stage with a low floatation retention time to produce a float containing most of the silica from the ore which is discarded; and, (c) adding additional cationic floatation reagent to the phosphate ore remaining from said first stage to said second stage with enough floatation retention time to produce a float containing most of the phosphate from the total cationic floatation tailings which is recovered.

2. An improved process according to claim 1, wherein said low floatation retention time is about one-third the normal time for cationic floatation.

3. An improved process according to claim 1, wherein the cationic floatation tailings from said second stage is mixed with a separate single float product.

4. An improved process according to claim 1, wherein the cationic floatation product from said second stage is used as a traditional double float product.

5. An improved process according to claim 1, wherein the amount of cationic floatation reagent added to said first and said second stage is approximately equal in volume to the amount of cationic floatation reagent added to a traditional double float process.

* * * * *